United States Patent [19]

Gorham

[11] 4,079,558

[45] Mar. 21, 1978

[54] MAGNETIC BOND STORM WINDOW

[75] Inventor: Robert B. Gorham, Mora, Minn.

[73] Assignee: Gorhams', Inc., Mora, Minn.

[21] Appl. No.: 652,996

[22] Filed: Jan. 28, 1976

[51] Int. Cl.[2] ..... E06B 3/28

[52] U.S. Cl. ..... 52/202; 49/478; 52/DIG. 4; 335/302

[58] Field of Search ..... 52/202, 203, DIG. 41; 49/57, 62, 478, 463; 160/DIG. 16, 368 S, 354; 335/302, 303

[56] References Cited

U.S. PATENT DOCUMENTS

| | | | |
|---|---|---|---|
| 2,219,699 | 10/1940 | Owen | 335/302 X |
| 3,133,324 | 5/1964 | Foreman | 49/478 X |
| 3,214,231 | 10/1965 | Bernard | 49/478 X |
| 3,378,957 | 4/1968 | Frehse | 49/478 X |
| 3,408,772 | 11/1968 | Frehse | 49/478 X |
| 3,465,536 | 9/1969 | Vogel et al. | 49/478 X |
| 3,805,872 | 4/1974 | Lorber | 160/DIG. 16 |
| 3,894,527 | 7/1975 | Ickes | 49/478 X |
| 3,939,620 | 2/1976 | Bero | 52/494 |

FOREIGN PATENT DOCUMENTS

| | | | |
|---|---|---|---|
| 944,994 | 12/1963 | United Kingdom | 160/354 |

*Primary Examiner*—J. Karl Bell

*Attorney, Agent, or Firm*—Merchant, Gould, Smith, Edell, Welter & Schmidt

[57] ABSTRACT

A storm window structure in which the face of a building structure and the edges of the associated storm window sashes are provided with members which interact magnetically to hold the sashes in position against the casing. One member is permanently magnetic and the other is ferromagnetic. Preferably the former is supplied in the form of a profile having grooves into which the pane may be inserted and cemented.

1 Claim, 5 Drawing Figures

MAGNETIC BOND STORM WINDOW

BACKGROUND OF THE INVENTION

This invention relates to the field of energy conservation, and particularly to means for reducing the loss of heat known to take place at the windows and other openings of buildings.

The provision of at least one window in a wall of each principal room in a house is desirable to provide natural light during the daylight hours, to maintain occupants of the rooms in communication with the world outside, and if necessary to provide emergency egress from the rooms. In general, the windows are arranged to open, at least in part, by "casement" or "double hung" construction, to accomplish ventilation of the rooms by admission of ambient outside air, and in most areas screens are a necessary adjunct to keep out airborne objects, insects, bats, and so forth.

Equally necessary as adjuncts, particularly in areas of less temperate climate, are storm windows, which function to permit entry of light while creating a dead air space to reduce heat transmission during the winter. The former routine of taking off storm windows and substituting screens in the spring, with the reverse procedure in the fall, is being replaced by the use of "combination" windows, which can serve either as storms or as screens, but some form of energy conservation is still necessary to prevent heating costs from rising intolerably in the winter.

Storm windows, whether elementary or "combined", are arranged to fit into the frames of the house windows, which have ledges at the top and sides for that purpose. Particularly with the more elementary arrangements, it is found that they perform their function only imperfectly. Even the most perfect workmanship seldom results in a space of truly dead air, and only slight leakage is required to materially reduce the efficiency of the arrangement. While the more modern arrangements are perhaps more perfect initially, the dimensional changes which occur in all buildings with age soon result in the appearance of small passages for movement of air into and out of the supposed dead space, with the related loss of efficiency.

SUMMARY OF THE INVENTION

The present invention proposes a new storm window structure which is simple and is simply installed, which is inexpensive, convenient, and efficient, which retains these virtues as outside the house and as a substitute for or a supplement to outside the house and a a substitute for or a supplement to storm windows already in existence.

These results are accomplished by attaching the storm window to the related frame magnetically. Strips of iron or other ferromagetic material are fastened to the face of the window frame, whether double-hung or casement, and a sheet of glass or plastic is provided with a frame including a layer of permanently magnetic material arranged to hold the window in the frame magnetically, resiliently, and removably. Our invention is easily adapted for use in the form of plural sashes with large windows where a single storm window sash would be unjustifiably heavy, bulky, or expensive.

Various advantages and features of novelty which characterize our invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

DESCRIPTION OF THE PREFERRED EMBODIMENTS

Figure 1:
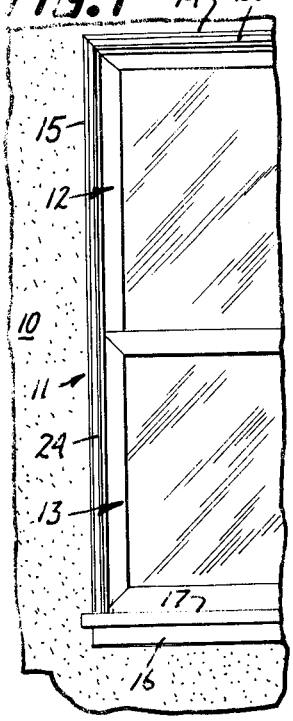
FIG. 1 is a fragmentary view in elevation of a window frame prepared to receive a storm window according to my invention.
Figure 3:
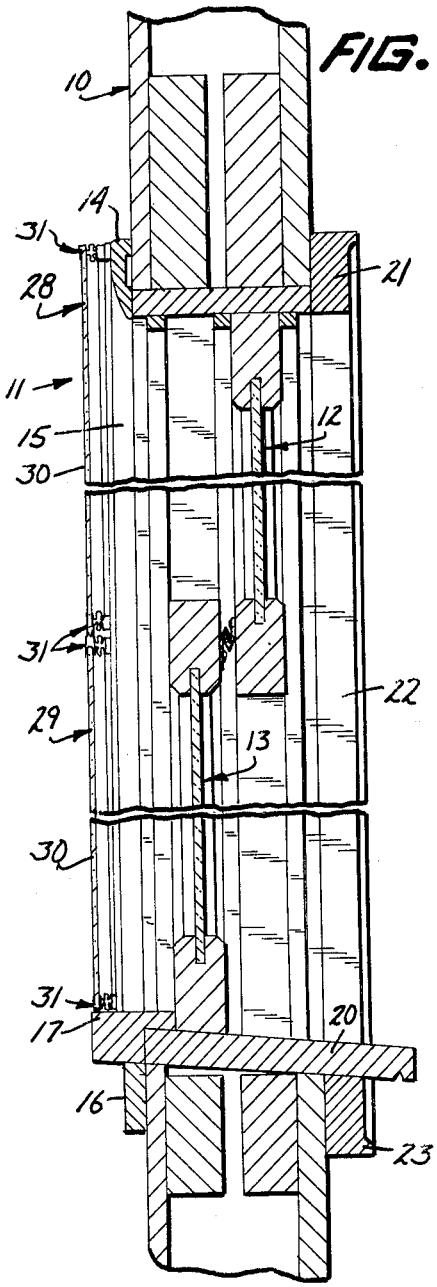
FIG. 3 is a vertical section along the line 3—3 of FIG. 2.

FIG. 1 shows a building wall 10 having an opening containing a double-hung window 11 including an upper sash 12, a lower sash 13, a casing including a top facing 14, side facings, one of which is shown at 15, a bottom facing 16, and a sill 17, as seen from the inside of a building. Sashes 12 and 13 comprise the primary closure of the building opening. The window is shown in vertical section in FIG. 3 to further comprise a stool 20 and outside trim including top, side and bottom casing members 21, 22 and 23. To practice our invention, flat strips of ferromagnetic material are secured to the side facings 15, as shown at 24, and a like strip 25 is secured to the top facing 14, by suitable means such as weather resistant cement 26 or flat headed screws. By preference the joints between the top and side strips are mitered. No strip is secured across the sill 17.

Figure 2:
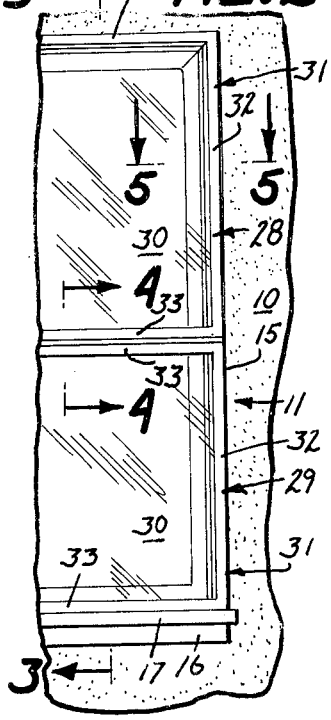
FIG. 2 is a view like FIG. 1 showing a storm window of two sections in position.
Figure 5:
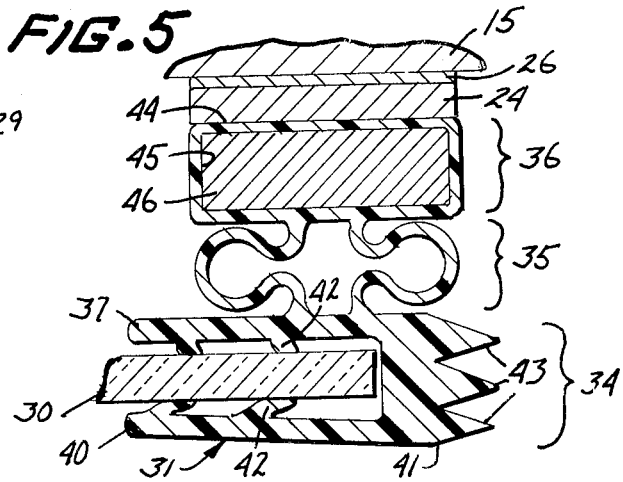
FIG. 5 is a horizontal fragmentary section along the line 5—5 of FIG. 2.

A storm window for application to the casing is shown in FIG. 2 to comprise two sashes 28 and 29, each comprising a pane 30 of rigid, transparent or translucent material surrounded by a framing 31 of material having special configuration and properties, the framing being provided in the form of vertical members 32 and horizontal members 33. As shown most clearly in FIG. 5, the cross section of the framing material, hereafter referred to as "profile", is in three portions 34, 35 and 36 in unitary, overlying relationship.

The outer portion 34 is of a rigid plastic in a generally U-shaped configuration. The legs 37 and 40 of the U taper convergingly toward their outer ends, and the material is sufficiently resilient that when a pane of transparent plastic, as thick as the inside width of the U at its closed end or base 41, is inserted into the open end of the U, the legs are spread sufficiently to firmly grip the pane material: small lugs 42 of softer material may be provided on the insides of the legs of the U to accentuate this effect if desired. A plurality of fingers 43 also of softer plastic extend outwardly from base 41 of the U, to serve a purpose presently to be described. The inner portion 36 has a flat surface 44 and a central cavity 45 to enclose a body 46 of permanently magnetic material. Portions 34 and 36 are joined by Portion 35 which is hollow and resilient. The framing members are preferably mitered at their corners, so that flat surfaces 44 define a single plane for cooperating with the plane hopefully defined by the ferromagnetic strips on the facings: layer 35 is sufficiently resilient to compensate for considerable irregularities.

Figure 4:
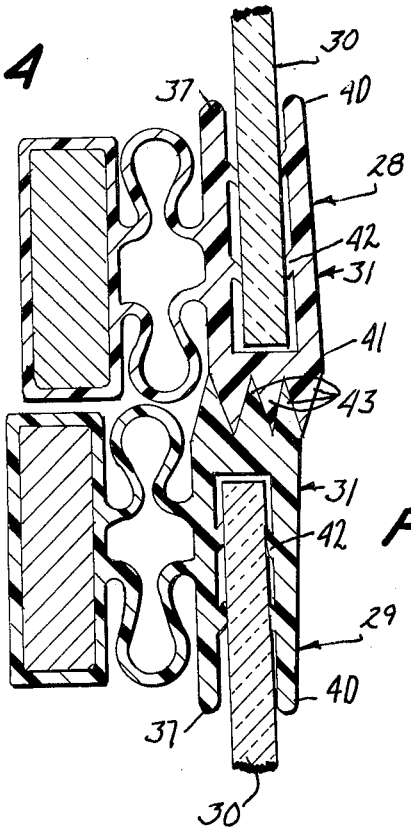
FIG. 4 is a vertical fragmentary section along the line 4—4 of FIG. 2 to a larger scale.

Panes 30 are so dimensioned and strips 21 are so positioned that the first storm window sash 29, comprising only pane 30 and framing 31, may simply be placed on sill 17, resting on fingers 43 along the lower framing member, flat surfaces 44 then being brought into alignment with strips 24. The thickness of layer 35 next to the flat surface is small, and the material is transparent to magnetism, so the sash is magnetically attracted and held to the window frame. The lower framing member of the second storm window sash 28 may now be rested on the upper framing member of the first sash, as shown in FIG. 4, the fingers 43 of the two framing members interdigitating to form a seal, and the remaining framing members may be brought into magnetic attachment with strips 24 and 25 as previously described.

For security, a few safety clips of any desired form may be applied to hold the window and frame together mechanically in the event of tempestuous weather, vandalism, or sudden high pressures developing without the house when a window sash is open.

This invention is well adapted to construction and installation of storm windows at the location of use. The material for strips 24 and 25 may be supplied ready-drilled and countersunk at convenient intervals, and need only be cut, beveled as necessary, and applied to the window casing as desired. The profile 31 can also be supplied in continuous rolls which also may be cut at the site to fit the metal framing. Magnetic material 46 is also available in strips and can be cut for sliding insertion into profile 31, suitable cement being used to insure permanence. The four prepared framing members are now applied and cemented to the edges of a glass or plastic cut to fit the opening, and the miters are sealed with the same cement: when the latter has set, a complete storm window sash results. For outside installation, glass is the preferred transparent material, while plastic may be used for lightness when installation is inside.

It will be appreciated that storm sashes according to our invention may be applied to the outer surface as well as the inner surface of the window casing, resting at the bottom on the stool instead of on the sill. It will also be appreciated that storm sashes according to our invention can even be installed over storm windows of the older kind when the additional protection is desired, being for example secured to the building wall around and on the sides of the opening to be protected.

While we have shown the magnetically susceptible material fastened to the frame and the permanently magnetic material secured to the pane, the reverse arrangement can also be used.

From the foregoing, it will be evident that we have invented a new and useful storm window structure by which storm sashes are held magnetically to the surfaces of the window frames, either inside or outside the building, giving a structure which is neat in appearance, of enduring low heat transfer, easily applied and removed, and adaptable to sectionalization for larger openings.

Numerous characteristics and advantages of our invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

What is claimed is:

1. In combination:

a window frame having a substantially flat casing around three edges thereof to define a substantial plane;

a substantially plane sheet of rigid transparent material to be applied over said window frame as a storm sash;

flat ferromagnetic strips secured along the face of said casing adjacent said three edges;

a mounting member extending along the edges of said sheet and made up of outer and inner portions connected by a hollow, resilient intermediate portion, said outer portion having a flat face for engaging said strip and said inner portion having opposed resilient edges at least one of which is grooved to receive said sheet, so that when said sheet is applied flatwise to said frame, said face of said mounting member engages said strips and an edge of said member engages the bottom of said window frame, all in sealing relation;

and permanently magnetic material in said mounting member adjacent said flat face for magnetically and resiliently holding said sheet to said frame.

* * * * *

UNITED STATES PATENT AND TRADEMARK OFFICE

CERTIFICATE OF CORRECTION

PATENT NO. : 4,079,558

DATED : March 21, 1978

INVENTOR(S) : Robert B. Gorham

It is certified that error appears in the above-identified patent and that said Letters Patent are hereby corrected as shown below:

Column 1, lines 50 and 51 should read as follows:

--these virtues as the building ages, and which can be applied either inside or outside the house as a substitute--.

Signed and Sealed this

*Third* Day of *October 1978*

[SEAL]

*Attest:*

RUTH C. MASON
*Attesting Officer*

DONALD W. BANNER
*Commissioner of Patents and Trademarks*